US006027089A

United States Patent [19]

Maharg et al.

[11] Patent Number: 6,027,089

[45] Date of Patent: Feb. 22, 2000

[54] MOUNTING BRACKET

[75] Inventors: James C. Maharg, Ridgefield, Conn.; Zenda Snyder, New York City, N.Y.

[73] Assignee: Look, Inc., New York, N.Y.

[21] Appl. No.: 09/138,709

[22] Filed: Aug. 24, 1998

[51] Int. Cl.[7] ..... A47B 96/06

[52] U.S. Cl. ..... 248/220.21; 403/103

[58] Field of Search ..... 248/221.11, 220.21, 248/220.22, 222.12, 222.52, 224.51, 205.1; 403/83, 84, 103, 91

[56] References Cited

U.S. PATENT DOCUMENTS

| | | | |
|---|---|---|---|
| 5,507,545 | 4/1996 | Krysiak | 248/222.12 X |
| 5,636,826 | 6/1997 | Nakagaki et al. | 248/224.51 X |
| 5,676,258 | 10/1997 | Leyden et al. | 248/225.11 X |
| 5,913,351 | 6/1999 | Miura | 403/103 X |

*Primary Examiner*—Ramon O. Ramirez

*Attorney, Agent, or Firm*—Levisohn, Lerner, Berger & Langsam

[57] ABSTRACT

A mounting bracket for a tension pole or other structure is provided. The bracket is provided with a spine which is fittable into a channel of a tension pole, scaffolding, or other primary support. The spine is preferably a parallelogram or a half-dovetail in section. A rotatable locking flange is provided in a break in the spine. When the locking flange is in the unlocked position, it is coaxial with the spine. When the locking flange is rotated into the locked position, the axis of the flange is orthogonal to the axis of the spine, and at least one of the ends of the flange juts out beyond the profile of the spine and behind the angled walls of the channel of the primary support. A handle is provided to facilitate rotation of the locking flange from an unlocked position to a locked position and back.

28 Claims, 9 Drawing Sheets

MOUNTING BRACKET

BACKGROUND OF THE INVENTION

1. Field of the Invention

The invention relates to mounting brackets and more specifically to mounting brackets that are mountable onto primary support structures such as tension poles, scaffolding, and the like as used in the visual display arts, for example.

2. Description of the Related Art

At many conventions, department stores, and the like, display booths are frequently employed. Such displays generally include some form of tension pole or the like as a primary support structure. Generally, it is disadvantageous to hang or suspend items directly from tension poles for several reasons. First, the tension pole is generally unattractive; it is better to find a way to de-emphasize the tension pole visually. Second, because the tension pole is not necessarily clean, any items that a person wishes to display may come in contact with dirt or grease on the tension pole and also become dirty. Third, such tension pole generally does not lend itself to supporting items to be displayed directly.

A common way to circumvent these problems is to provide shelves or cross-beams on which the items to be displayed may be placed. In the case of shelves, items are placed on the shelves. In the case of cross-beams, garments, for example, may be disposed on hangers which are suspended from the cross-beams.

Typically, shelves and cross-beams are attached to tension poles by means of a mounting clamp. A conventional mounting clamp employed in the visual display arts is made by the ALU Corporation of New York. The ALU clamp includes a threaded handle which, when rotated repeatedly, opens or closes a pair of grips, depending on the direction of rotation. The grips are designed to clamp around the outer circumference of the tension pole onto which it is desired to attach a cross-beam or a shelf. A recess is provided in the ALU clamp into which a cross-bar or pole may be inserted. Another threaded handle is provided with a bolt; when the second handle is rotated, the bolt moves into the recess and pushes against any bar or pole inserted therein, as is conventional in the art.

The ALU clamp suffers from several drawbacks. First, it is difficult to attach to a primary support structure. The clamp must be fully opened, placed around the tension pole, and then the handle must be turned repeatedly in order to secure the clamp to the tension pole. The repeated turning of the handle to close the grips around the tension pole is a slow and cumbersome process. What is more, while the handle is being turned, the clamp must be held in the desired location, since it is not secured until the grips are snug around the tension pole; during the attaching process, the clamp is likely to slip or shift position. Should the tension pole be too wide for the grips of the clamp to wrap around, the clamp cannot be attached. Moreover, the recess for receiving a cross-bar is also fixed in cross-section and shape and can accommodate neither a pole or bar that is wider than the recess nor a shelf.

SUMMARY OF THE INVENTION

It is an object of the invention to provide a mounting bracket securable to a tension pole that is easily operated.

It is another object of the invention to provide a mounting bracket securable to a tension pole that is swiftly and securely locked or unlocked to the tension pole.

It is another object of the invention to provide a mounting bracket capable of receiving a number of different display devices, such as a shelf or a cross-bar.

It is another object of the invention to provide a mounting bracket which is simple to operate and basically requires a single motion by the user to lock and hold the same in position and a single reverse motion to disassemble the same.

It is another object of the invention to provide a mounting bracket which has a locking and unlocking mechanism which operates by a simple turning of a handle.

It is another object of the invention to provide a system of displaying items which is easy to assemble and dissemble.

The above and other objects of the invention are accomplished by providing a mounting bracket that has a main body and a spine, protruding from the main body, having a first longitudinal axis and a profile. A break or gap in the spine is provided. A support surface, designed to support a cross-bar, a shelf, or other similar structure, is attached to the main body. The invention includes a locking flange, rotatably provided in the break of the spine, rotatable between a first unlocked position and a second locked position. The spine is fittable into a channel of a primary support, and is preferably one of a rectangle, parallelogram, or a one-half dovetail in profile or section. The locking flange includes at least one free end and preferably two free ends and a second longitudinal axis extending from one free end to the other free end. When the locking flange is in the first unlocked position, the longitudinal axis of the flange is coaxial with the longitudinal axis of the spine. When the locking flange is in the second locked position, the longitudinal axis of the flange is orthogonal to the longitudinal axis of the spine, and at least one of the free ends of the locking flange extends beyond the profile of the spine thereby locking the bracket into the channel of the primary support. Preferably, the free ends are rounded to facilitate the rotation of the locking flange into and out of the channel and thus into and out of the locked position.

A shaft is attached to the locking flange at a first end of the shaft, the shaft being perpendicular to the longitudinal axis of the locking flange. A bore is formed through the main body corresponding to the break in the spine, and the shaft passes through the bore disposing the locking flange on one side of the main body. A handle is attached to the second end of the shaft and is disposed on the other side of the main body. Rotation of the handle rotates the shaft and the locking flange between the first unlocked position and the second locked position.

The support surface may include a flat portion that is adapted to receive a shelf. Alternatively, the support surface may include a hollowed semi-cylindrical portion that is adapted to receive a cylindrical pole or bar, or may include a hollowed squared-off semi-cylindrical portion that is adapted to receive a pole or bar which is square or rectangular in section. A clamp is provided that is securable to the support surface for securing a shelf, pole, or bar (or similar structure) to the bracket. An opposing surface of the clamp may be flat, for securing a shelf, a hollowed semi-cylinder, for securing a cylindrical pole or bar, or a hollowed squared-off semi-cylinder, for securing a pole or bar which is square or rectangular in section. The poles or bars to be secured to bracket may be hollow or solid. The support surface is preferably orthogonal to the main body of the bracket for enhanced stability.

The invention also includes a system for displaying items that includes a primary support having a channel formed therein, and a mounting bracket as described above. The preferred primary support is the tension pole described in co-pending U.S. patent application Ser. No. 09/047,597 entitled Floor to Ceiling Tension Support Pole with Locking Mechanism, filed Mar. 25, 1998, the teachings of which are herein incorporated by reference. The spine of the main body of the mounting bracket is fittable into the channel of the primary support. The invention includes a biasing spring disposed on the shaft on the handle side of the shaft. The biasing spring pulls the locking flange towards the main body so that the locking flange is snugly secured in the channel when the locking flange is in the second locked position.

These and other aspects of the present invention will be more easily understood when the following description of the invention is considered with reference to the drawings.

Figure 2A:
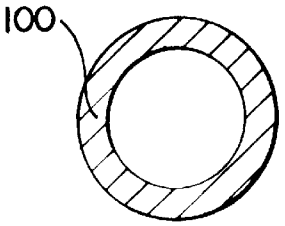
FIG. 2A is a sectional view of a cross-bar to be used with the mounting bracket of FIG. 1, taken along line IIA—IIA of FIG. 1.

DETAILED DESCRIPTION OF THE DRAWINGS AND THE PREFERRED EMBODIMENT OF THE INVENTION

Description of the invention will now be given with reference to the drawings. As illustrated in FIGS. 1–5, mounting bracket 10 is provided with a main section 20 having a raised ridge or spine 22 on one side. The spine 22 is provided with a certain geometrical profile for reasons that will be explained below. A locking flange 24 is rotatably disposed in a break 26 of spine 22, preferably in a roughly central location. A bore 28 is formed through section 20. Locking flange 24 is disposed on a first end 31 of a shaft 30 which passes through bore 28. Locking flange 24 is preferably integral with shaft 30, or may be fastened thereon. In either event, locking flange 24 is fixed with respect to shaft 30; when shaft 30 is rotated about its longitudinal axis, locking flange 24 turns with it.

The bracket 10 is designed to be mounted on a tension pole or other primary support piece having a channel formed therein. Spine 22 is placed in the channel of the primary support; thereafter, and locking flange 24 is rotated into a locking position (see FIG. 8B) in which the ends 24-1 and 24-2 of the flange 24 extend beyond the profile of spine 22, wedge into the channel of the primary support structure, and secure bracket 10 to the support structure. The exact mechanism for the securing of the bracket via the rotation of the locking flange will be explained in greater detail below.

Figure 9:
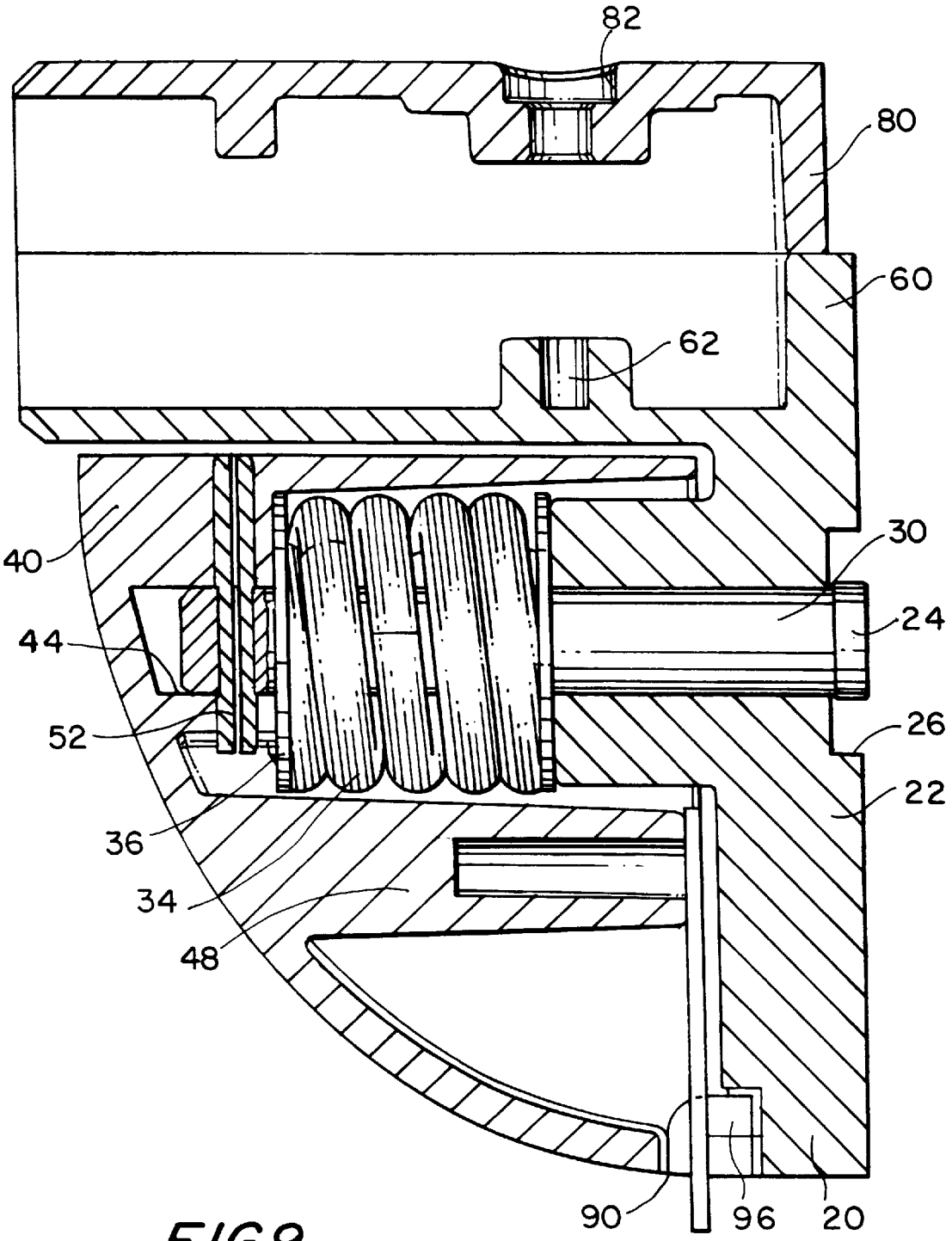
FIG. 9 is a sectional view of the mounting bracket taken along line IX—IX in FIG. 3.

A handle 40 is attached to a second end 33 of shaft 30. Hub 44 (see FIG. 9) is provided in an interior portion of handle 40 for receiving end 33 of shaft 30. Bore 42 is formed in handle 40, and bore 32 is formed in shaft 30 in alignment with bore 42, so that the handle 40 and the shaft 30 may be fixed to one another via pin 52. When handle 40 is rotated, shaft 30 is rotated, and thus locking flange 24 is also rotated. Biasing spring 34 is placed around shaft 30 to bias the shaft 30 towards the handle and the locking flange 24 towards main section 20. A spring mounting hub 25 having spaced ribs 27 is provided on an interior surface of main section 20. Shims 36 are attached to the ends of biasing spring 34 to distribute the compressive forces of the spring evenly.

Figure 2B:
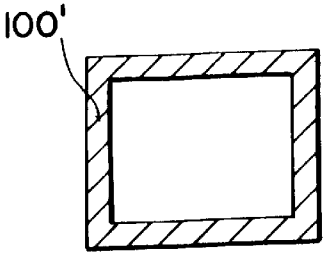
FIGS. 2B is a sectional view of an alternative cross-bar to be used with a mounting bracket according to the invention.
Figure 1:
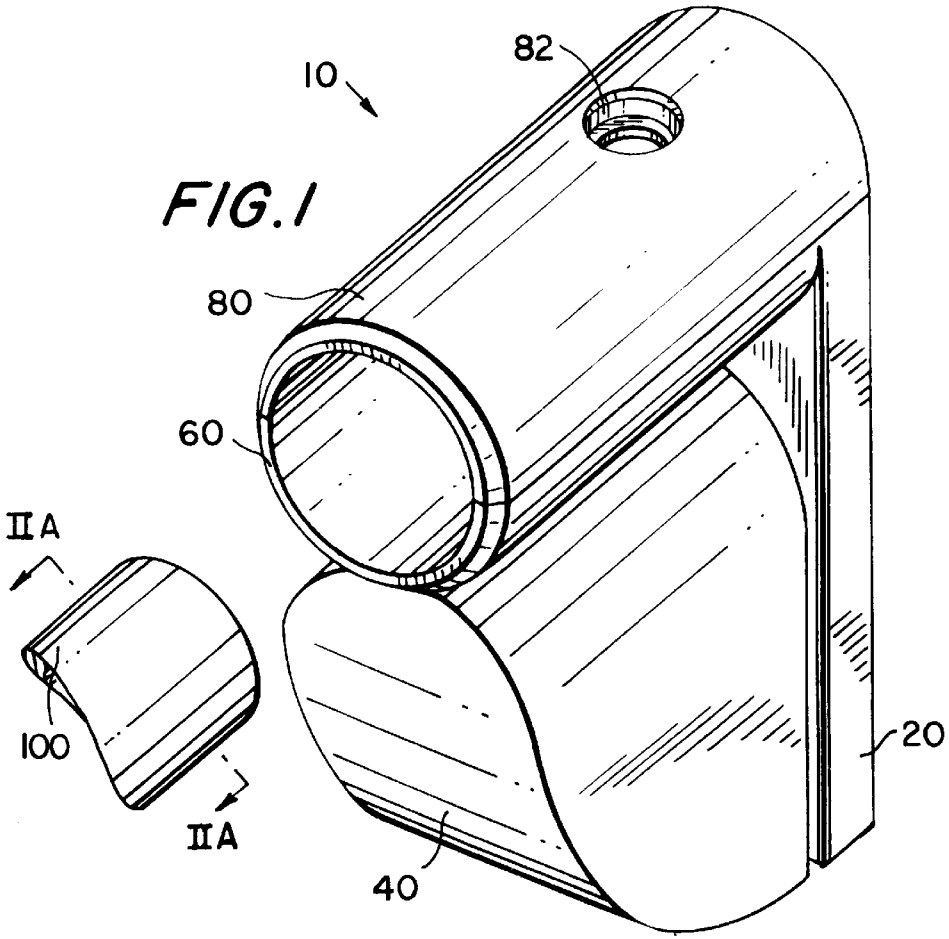
FIG. 1 is left perspective view of a mounting bracket according to the invention.
Figure 3:
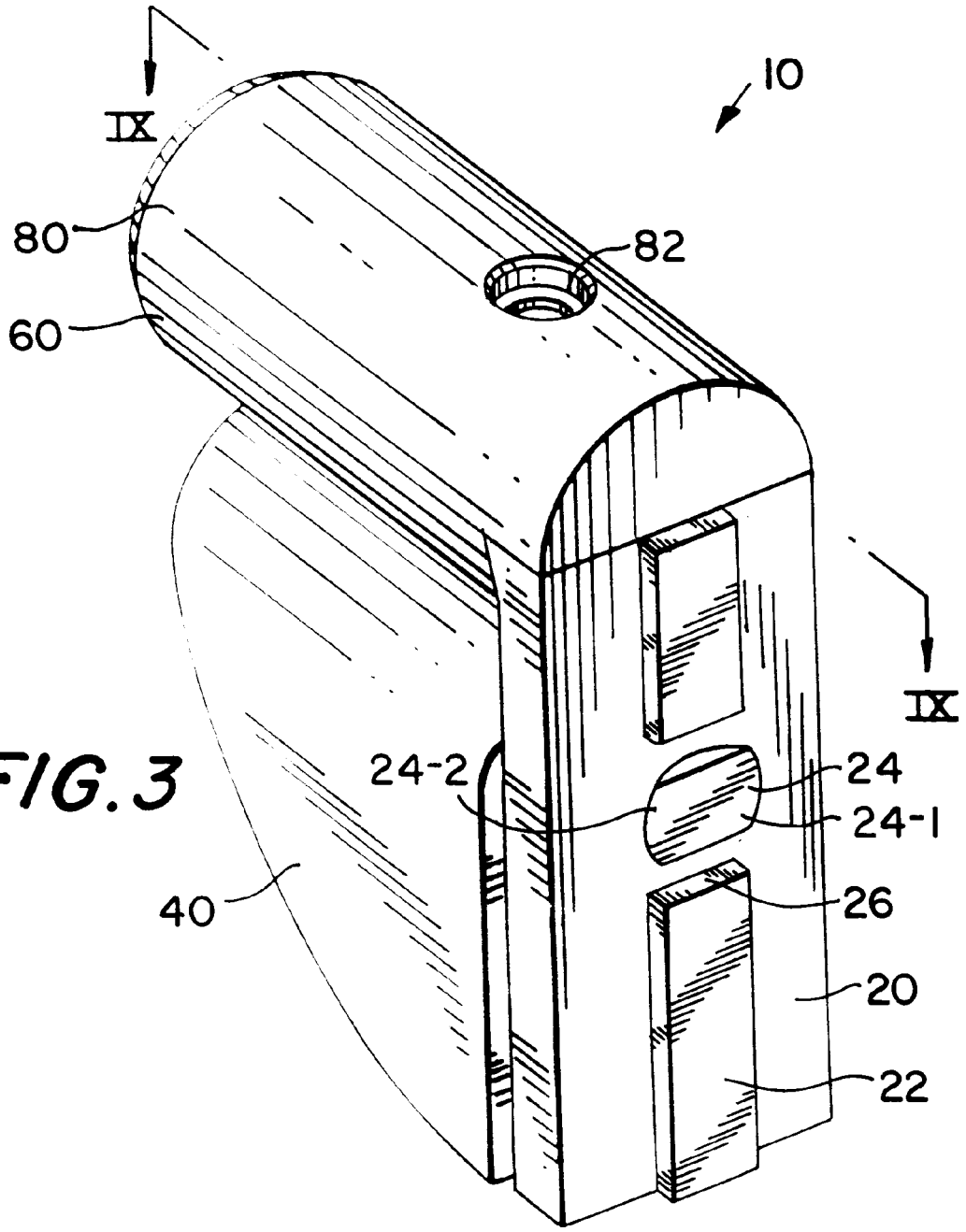
FIG. 3 is a right perspective view of the mounting bracket of FIG. 1.
Figure 4:
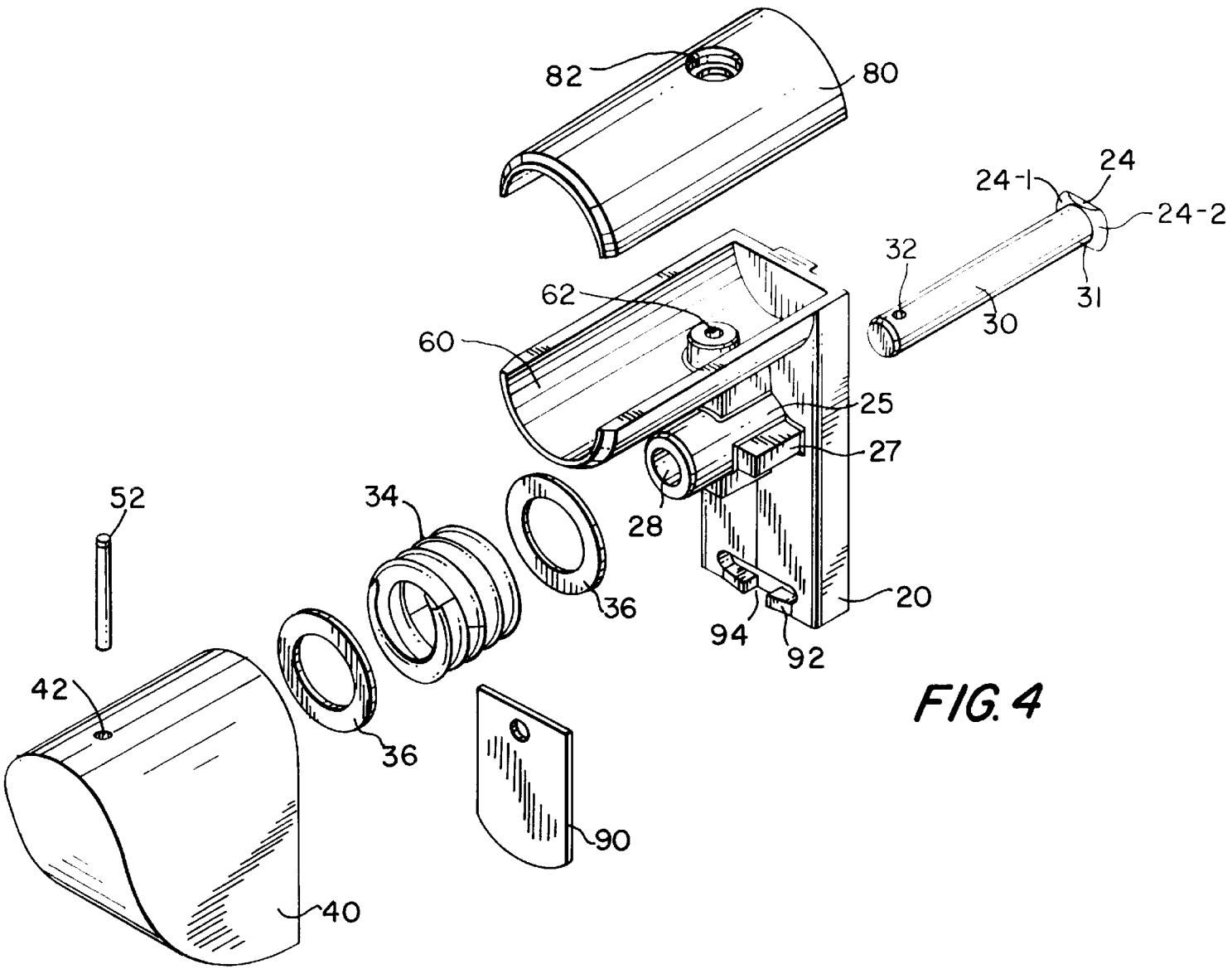
FIG. 4 is a left exploded perspective view of the mounting bracket of FIG. 1.
Figure 5:
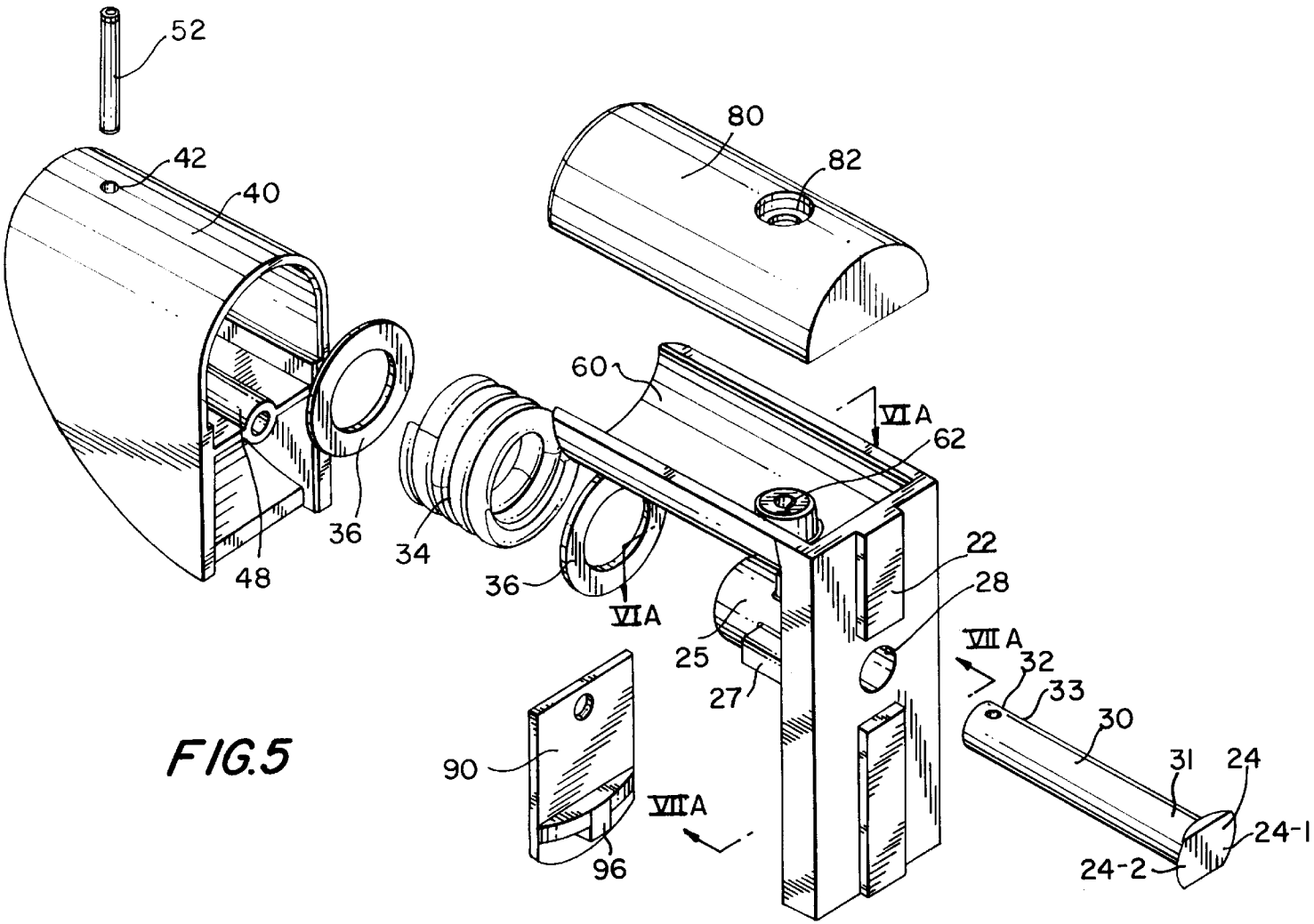
FIG. 5 is a right exploded perspective view of the mounting bracket of FIG. 1.
Figure 6A:
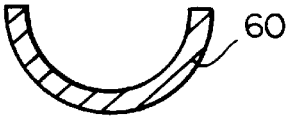
FIG. 6A is a sectional view of the support ledge of the mounting bracket taken along line VIA—VIA in FIG. 5.
Figure 6B:
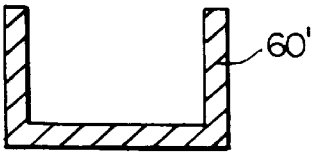
FIG. 6B is a sectional view of an alternate support ledge of a mounting bracket according to the invention.
Figure 10:
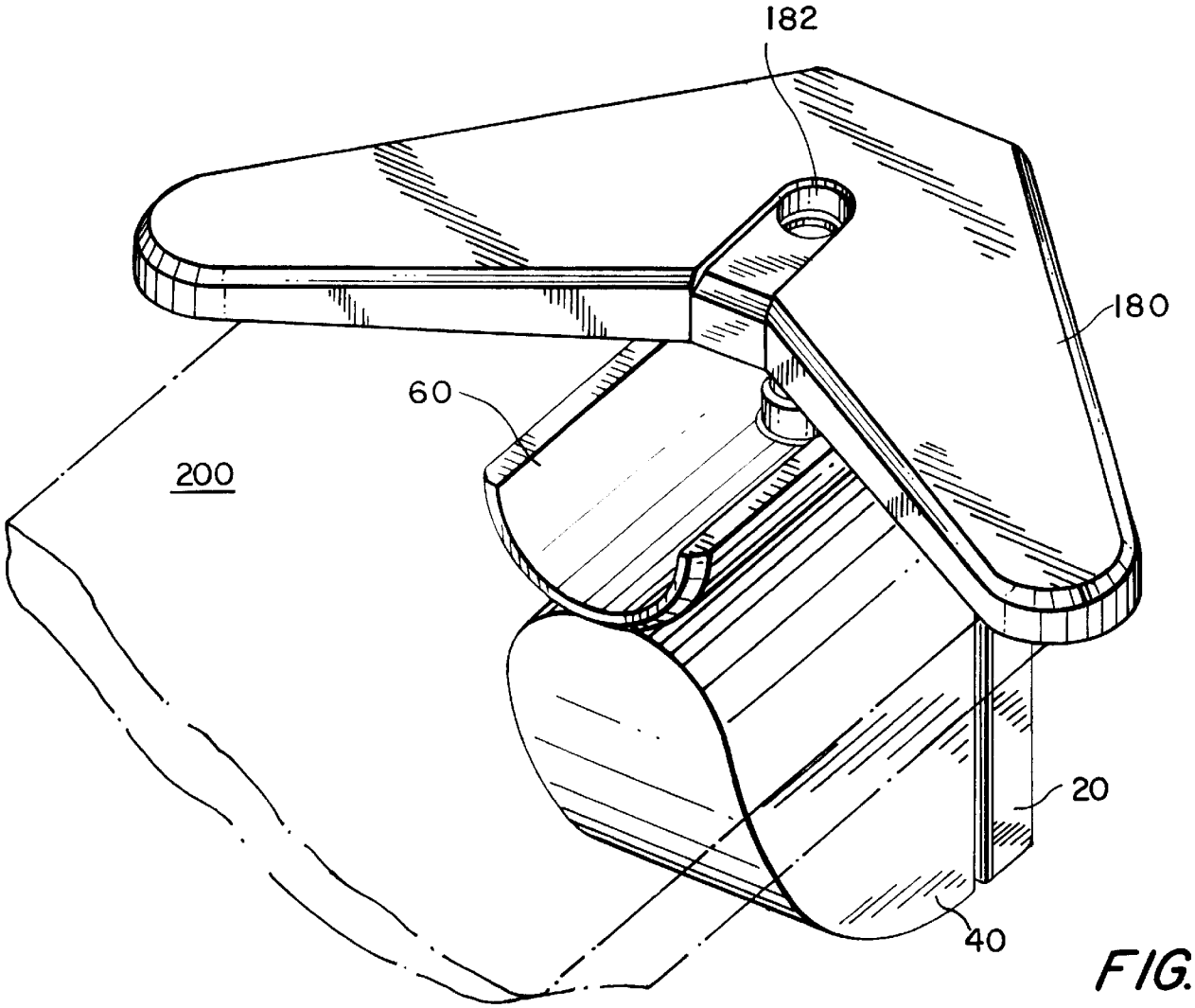
FIG. 10 is a perspective view of the mounting bracket securing a shelf support and shelf (in dotted outline) thereto.

Attached to, and preferably orthogonal to, main section 20 is a support platform 60, which provides a support surface onto which a secondary support structure may be attached, such as a shelf 200 (see FIG. 10) or a cross-bar 100 (see FIGS. 1–2). Support platform 60 may be a semi-circular cylindrical piece (i.e., a "half-pipe") for receiving a round cross-bar such as cross-bar 100, as shown in FIGS. 1, 2A, 3–5, and 6A, or it may be a squared-off semi-cylindrical piece as shown in FIG. 6B, for receiving a square or rectangular cross-bar 100' (see FIG. 2B). A corresponding clamp 80 is provided to clamp down and secure the cross-bar or shelf onto support platform 60. When it is desired to secure a cross-bar 100 or other pipe-shaped element, a rounded clamp 80 as illustrated in FIGS. 1, 3, and 5 may be employed. When it is desired to secure a shelf 200 or other planar element, a flat, planar clamp 180 as illustrated in FIG. 10 may be employed. In either case, support platform 60 is provided with bore 62, and clamps 80 or 180 are provided with bores 82 or 182, respectively, so that a bolt or a threaded element (not shown) may fasten the clamp to the support platform and thus secure either a shelf or a cross-bar therebetween.

Figure 11A:
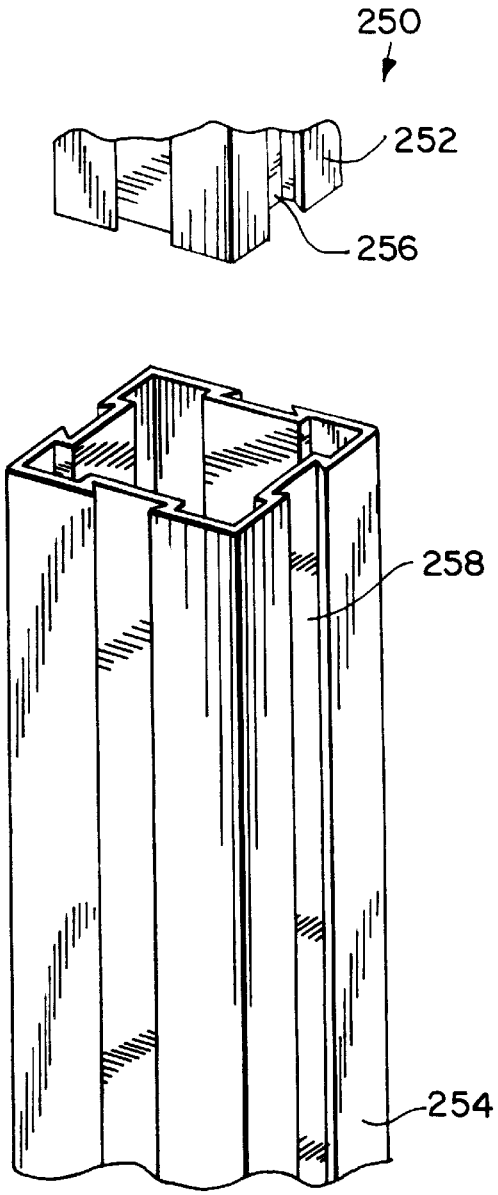
FIG. 11A is an exploded perspective view of the telescopic pole pieces, i.e., the inner, upper pole piece and the outer, lower pole piece of the preferred tension pole to which the inventive mounting bracket may be attached.
Figure 11B:
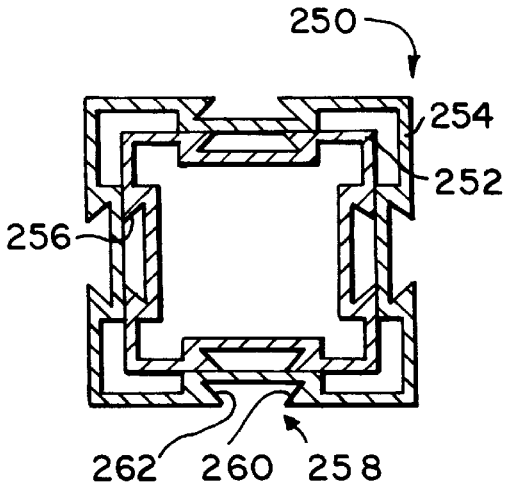
FIG. 11B is a cross-sectional view of the telescopic pole pieces, i.e., the inner, upper pole piece and the outer, lower pole piece of the preferred tension pole to which the inventive mounting bracket may be attached.

In the preferred embodiment of the invention, the mounting bracket 10 is to be used with a tension pole or similar support structure having a channel formed therein. One such tension pole 250 is depicted in FIGS. 11A–B. The tension support pole 250 basically comprises two tension pole pieces 252 and 254. A locking mechanism (not shown) is provided to ensure that the requisite tension is provided to lock the pole pieces between floor and ceiling and to one another. Pole piece 254 is the outer, lower pole while inner, upper pole 252 is located within and above pole piece 254.

The pole pieces 252 and 254 are basically square or rectangular in cross-section and tubular yet provided on one or more faces with dovetail shaped channels 256 and 258 running along their length. The advantages of a square-sectioned pole piece are several in nature. A square tension pole according to the invention is more aesthetically pleasing and structurally sound than a round tension pole. A horizontal support platform can be easily fitted between two square tension poles without leaving a gap; the straight edge of a typical support platform or shelf would leave a gap when abutting a tension pole having a circular cross-section. The pole pieces 252 and 254 are preferably made from extruded aluminum although other materials may, of course, be used as is understood by those of ordinary skill in the art. Aluminum is the preferred material of choice because it is relatively lightweight and, yet, provides structural strength and rigidity. Also, aluminum can be easily formed by metal working and/or extrusion processing.

The outer, lower pole piece 254 has at least one longitudinal dovetail channel 258 running along its length. The inner, upper pole piece 252 has at least one longitudinal dovetail channel 256 running along its length. A dovetail channel may be provided to each side of both pole pieces for a variety of other support usages, such as the attachment of mounting bracket 10, for example, so that a secondary support element such as a shelf or a cross-bar may be attached. The pole pieces 252 and 254 slide with respect to one another. As mentioned above, the preferred tension pole is described in a more detailed fashion in co-pending U.S. patent application Ser. No. 09/047,597 entitled Floor to Ceiling Tension Support Pole with Locking Mechanism, filed Mar. 25, 1998, the teachings of which are herein incorporated by reference.

Figure 7A:
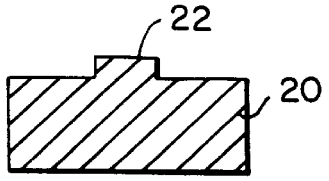
FIG. 7A is a sectional view of the main body of the mounting bracket taken along line VIIA—VIIA in FIG. 5.
Figure 7B:
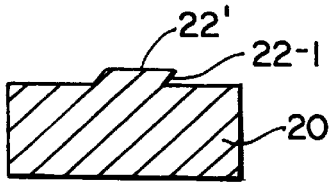
FIG. 7B is a sectional view of the main body of the mounting bracket having a preferred alternate profile.
Figure 7C:
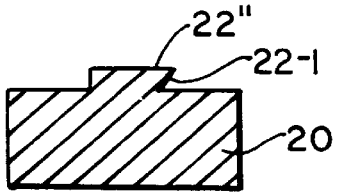
FIG. 7C is a sectional view of the main body of the mounting bracket having a second alternate profile.

The spine 22 of the mounting bracket 10 is dimensioned to fit in one of the channels of the tension pole, for example channel 258 in the outer, lower tension pole piece 254. To this end, the spine may be rectangular in section, as shown in FIG. 7A. In this case, the width of spine 22 should be slightly narrower than the opening of dovetail channel 258. In two preferred embodiments, the spine is not fully rectangular in section but either a parallelogram (see spine 22' in FIG. 7B) in section or a half-dovetail (see spine 22" in FIG. 7C) in section. The angled side wall 22-1 of the spines 22' and 22" fits behind the angled side wall 260 of channel 258 to provide a more snug or secure fit than if a straight rectangular spine is employed. However, owing to the operation of the locking flange 24, a spine that is rectangular in section (see FIG. 7A) may be employed, because the ends 24-1 and 24-2 of locking flange 24 are rotated behind the angled side walls 260, 262 of dovetail channel 258 when the flange is turned into its locking position.

Figure 8A:
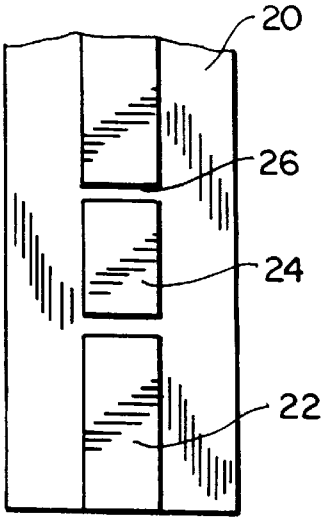
FIG. 8A is a front plan view of the mounting bracket in an unlocked position.
Figure 8B:
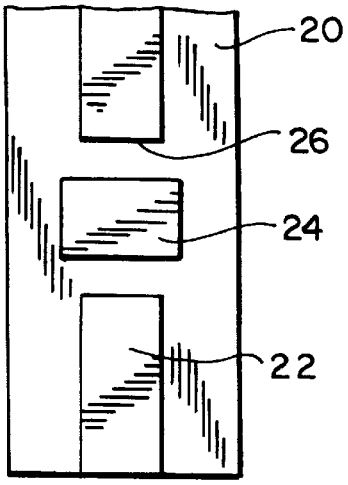
FIG. 8B is a front plan view of the mounting bracket in a locked position.
Figure 12A:
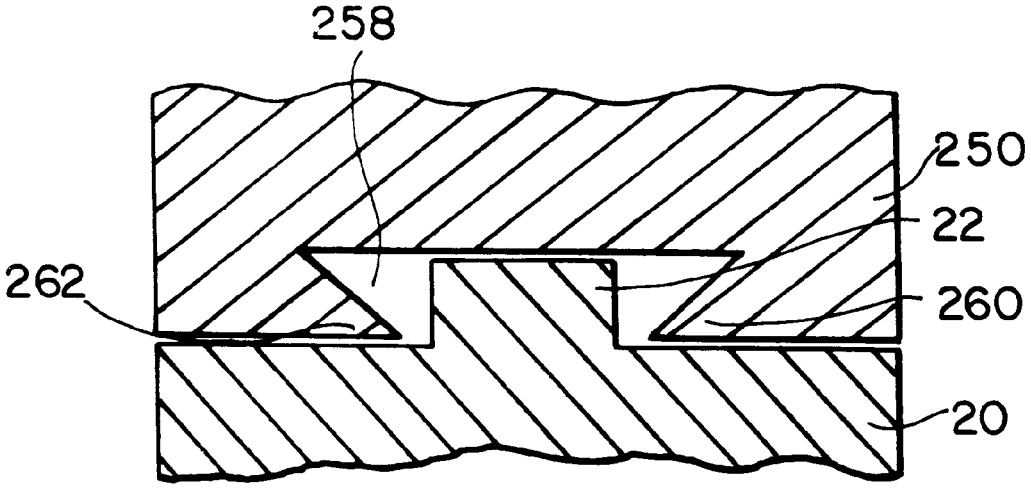
FIG. 12A is a cross-sectional schematic of the spine of the mounting bracket fitted, but not locked, into the tension pole of FIG. 11.
Figure 12B:
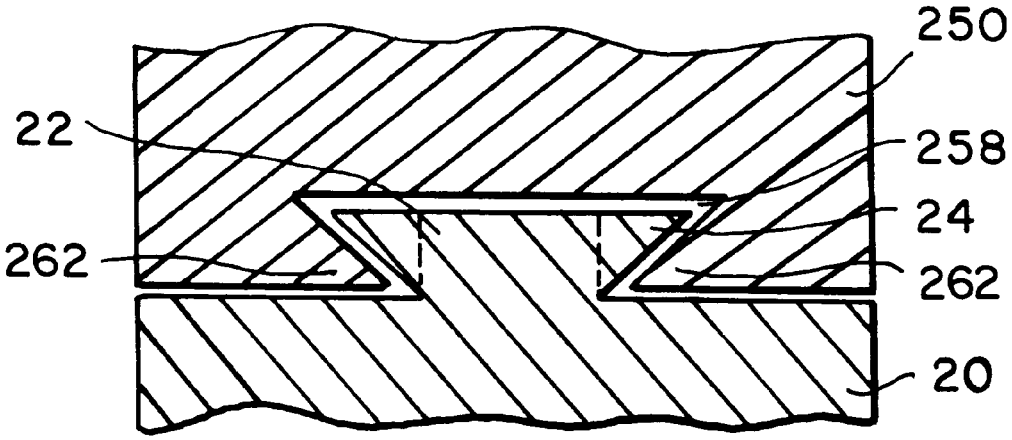
FIG. 12B is a cross-sectional schematic of the spine of the mounting bracket locked into the tension pole of FIG. 11.

As shown in FIG. 8A, when locking flange 24 is in the unlocked position, locking flange 24 is coaxial with spine 22, and is preferably flush with the profile of spine 22. When locking flange 24 is rotated into its locked position, as shown in FIG. 8B, the longitudinal axis of locking flange 24 is orthogonal to the axis of spine 22, and at least one end of the locking flange sticks out beyond the profile of spine 26. That way, the ends of the locking flange are rotated into the back corners of the dovetail channel 258, as shown in FIG. 12B. Biasing spring 34 pulls locking flange 24 towards main section 20 thereby cinching the ends of the flange around the angled sides 260, 262 of dovetail channel 258.

The mounting bracket may be provided with a safety catch 90 to prevent accidental or unintended rotation of the handle. Catch 90 is attached to handle 40 via hub 48. As shown in FIG. 5, catch 90 is provided with a tab 96 and main section 20 is provided with block 92 having groove 94 (see FIG. 4). Tab 96 is designed to be slidable into groove 94 when the handle 40 is aligned vertically with the main section 20, i.e., is in the locked position.

In operation, the invention works as follows. Suppose it is desired to mount cross-bar 100 on tension pole 250. Mounting bracket 10 is deployed with the locking flange 24 in its unlocked position (see FIGS. 8A and 12A). Spine 22 (or 22' or 22") is fitted into dovetail channel 258, as shown in FIG. 12A. Handle 40 is then rotated 90°. Because handle 40 and locking flange 24 are both fixedly attached to shaft 30, the rotation of handle 40 causes locking flange 24 to rotate 90° into its locked position (see FIGS. 8B and 12B). In this locked position, the ends 24-1 and 24-2 of locking flange 24 are rotated behind angled walls 260, 262 of dovetail channel 258. Mounting bracket 10 is thus secured to tension pole 250. It is preferred that the ends of the locking flange 24 are rounded (as shown in FIGS. 3 and 5, for example) to facilitate their rotation behind angled walls 260 and 262. Thereafter, cross-bar 100 is placed in support platform 60, and clamp 80 is bolted down on top of cross-bar 100, clamping the cross-bar to the support platform. Alternatively, the cross-bar may be provided with a bore that is collinear with bores 62 and 82, in which case a bolt is passed through all three of clamp 80, cross-bar 100, and support platform 60, respectively. Bore 62 may be provided with a screw thread to secure the bolt. The other end of the cross-bar may be mounted in another mounting bracket in the same way if it is desired to have both ends fixed to a primary support structure; otherwise, the cross-bar may be a cantilever.

In the preferred embodiment, the handle 40 aligns with main body 20 when the locking flange 24 is locked into the dovetail channel to present a streamlined look to the assembled and mounted structure.

The mounting bracket is preferably molded or formed from zinc, aluminum, or other lightweight non-corrodible metal and can be coated with rubber or plastic for texture/aesthetics or, it, too, can be molded from strong plastic. It, too, can be formed of other materials depending upon the desired look of the handle, weight, economy of manufacture, etc.

The invention is not limited to the above description. For example, the above description discusses the use of a single channel on one of the upper or lower pole pieces. However, as shown in the figures, multiple channels may be provided and used. For example, a number of mounting brackets may be attached to the same tension pole, or, conversely, a user has greater flexibility in positioning a single mounting bracket on a tension pole with multiple channels without having to rotate or move the tension pole. Providing such multiple channels makes the tension pole more advantageous and easier to use.

Also, the above description discusses square pole pieces. However, the invention is not so limited and covers any geometric configuration. For example, the cross section of the pole pieces may be triangular, hexagonal, octagonal, or in the shape of any polygon. The tension pole may also be circular, so long as a channel is provided therein. The cross-section of the tension pole may also be any convenient irregular shape.

Further, the above description discusses channels having a dovetail shape. However, any shaped channel can be used with the invention. For example, the channel may be T-shaped. Similarly, the ends of the locking flange need not be rounded but may be squared off or provided with any other convenient geometry. The flange need not be symmetrical. An asymmetrical flange may be provided. Or, alternatively or additionally, the locking flange may be eccentrically disposed on the shaft, so that only one free end of the flange is rotated behind the angled walls of the dovetail channel when the locking flange is rotated into its locked position.

The above specification and the detailed description of the preferred embodiment are to be considered as representative, only, as the scope of the invention to which we are entitled, is intended to be covered by the scope of the claims, as interpreted by the Courts, and their reasonable and legal equivalents, as also interpreted by the Court and the applicable statutes.

We claim:

1. A mounting bracket, comprising:

a main body;

a spine, protruding from said main body, having a first longitudinal axis and a profile, said spine having a break;

a support surface attached to said main body; and a locking flange, rotatably provided in said break of said spine, rotatable between a first unlocked position and a second locked position.

2. A mounting bracket according to claim 1, wherein said spine is fittable into a channel of a primary support.

3. A mounting bracket according to claim 2, wherein said profile of said spine is a rectangle.

4. A mounting bracket according to claim 2, wherein said profile of said spine is a parallelogram.

5. A mounting bracket according to claim 2, wherein said profile of said spine is a one-half dovetail.

6. A mounting bracket according to claim 1, wherein said locking flange comprises at least one free end and a second longitudinal axis, wherein when said locking flange is in said first unlocked position, said second longitudinal axis is coaxial with said first longitudinal axis, and when said locking flange is in said second locked position, said second longitudinal axis is orthogonal to said first longitudinal axis and said at least one free end of said locking flange extends beyond said profile of said spine.

7. A mounting bracket according to claim 6, wherein said at least one free end is rounded.

8. A mounting bracket according to claim 1, wherein said locking flange comprises at least one free end and a second longitudinal axis, wherein when said locking flange is in said first unlocked position, said second longitudinal axis is coaxial with said first longitudinal axis, and when said locking flange is in said second locked position, said second longitudinal axis is orthogonal to said first longitudinal axis and said at least one free end of said locking flange extends beyond said profile of said spine thereby locking said bracket into the channel of the primary support.

9. A mounting bracket according to claim 8, wherein said at least one free end is rounded.

10. A mounting bracket according to claim 1, further comprising:

a shaft attached to said locking flange at a first end of said shaft, said shaft being perpendicular to said second longitudinal axis of said locking flange;

a bore formed through said main body corresponding to said break in said spine, said shaft passing through said bore disposing said locking flange on a first side of said main body;

a handle attached to a second end of said shaft disposed on a second side of said main body, wherein rotation of said handle rotates said shaft and said locking flange between said first unlocked position and said second locked position.

11. A mounting bracket according to claim 1, wherein said support surface includes a flat portion and is adapted to receive a shelf.

12. A mounting bracket according to claim 1, wherein said support surface includes a hollowed semi-cylindrical portion and is adapted to receive a cylindrical pole or bar.

13. A mounting bracket according to claim 1, wherein said support surface includes a hollowed squared-off half-tube portion and is adapted to receive a pole or bar which is square or rectangular in section.

14. A mounting bracket according to claim 1, further comprising a clamp securable to said support surface.

15. A mounting bracket according to claim 14, wherein an opposing surface of said clamp is flat and is adapted to secure a shelf onto said support surface.

16. A mounting bracket according to claim 1, wherein an opposing surface of said clamp is a hollowed semi-cylinder and is adapted to secure a cylindrical pole or bar to said support surface.

17. A mounting bracket according to claim 1, wherein an opposing surface of said clamp is a hollowed squared-off half-tube and is adapted to secure a pole or bar which is square or rectangular in section to said support surface.

18. A mounting bracket according to claim 1, wherein said support surface is orthogonal to said main body.

19. A system for displaying items, comprising:

a primary support;

a channel formed in said primary support;

a mounting bracket, including:

a main body;

a spine, protruding from said main body and having a first longitudinal axis and a profile, said spine having a break;

a support surface attached to said main body; and a locking flange, rotatably provided in said break of said spine, rotatable between a first unlocked position and a second locked position.

20. A system according to claim 19, wherein said spine is fittable into said channel of said primary support.

21. A system according to claim 19, wherein said locking flange comprises at least one free end and a second longitudinal axis, wherein when said locking flange is in said first unlocked position, said second longitudinal axis is coaxial with said first longitudinal axis, and when said locking flange is in said second locked position, said second longitudinal axis is orthogonal to said first longitudinal axis and said at least one free end of said locking flange extends beyond said profile of said spine thereby locking said bracket into said channel of said primary support.

22. A system according to claim 19, further comprising:

a shaft attached to said locking flange at a first end of said shaft, said shaft being perpendicular to said second longitudinal axis of said locking flange;

a bore formed through said main body corresponding to said break in said spine, said shaft passing through said bore disposing said locking flange on a first side of said main body;

a handle attached to a second end of said shaft disposed on a second side of said main body, wherein rotation of said handle rotates said shaft and said locking flange between said first unlocked position and said second locked position.

23. A system according to claim 22, further comprising:

a biasing spring disposed on said shaft on said second side of said main body, wherein said biasing spring pulls said locking flange towards said main body so that said locking flange is snugly secured in said channel when said locking flange is in said second locked position.

24. A system according to claim 19, further comprising a substantially flat shelf attachable to said support surface.

25. A system according to claim 24, further comprising a clamp securable to said support surface, wherein an opposing surface of said clamp is flat and is adapted to secure said shelf onto said support surface.

26. A system according to claim 19, further comprising a cross-bar attachable to said support surface.

27. A system according to claim 26, further comprising a clamp securable to said support surface, wherein an opposing surface of said clamp geometrically matches a profile of said cross-bar and is adapted to secure said cross-bar to said support surface.

28. A system according to claim 19, wherein said channel in said primary support is one of a rectangle, a parallelogram, and a dovetail in section.

* * * * *